US006291412B1

(12) United States Patent
Kvita et al.

(10) Patent No.: US 6,291,412 B1
(45) Date of Patent: Sep. 18, 2001

(54) WATER-SOLUBLE GRANULES OF PHTHALOCYANINE COMPOUNDS

(75) Inventors: Petr Kvita, Reinach (CH); Pierre Dreyer, Blodelsheim (FR)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 0 days.

(21) Appl. No.: 09/312,228

(22) Filed: May 14, 1999

(30) Foreign Application Priority Data

May 18, 1998 (EP) ..... 98810459

(51) Int. Cl.[7] ..... C11D 3/00
(52) U.S. Cl. ..... 510/301
(58) Field of Search ..... 510/301

(56) References Cited

U.S. PATENT DOCUMENTS

| | | | | |
|---|---|---|---|---|
| 4,394,125 | | 7/1983 | Hölzle et al. | 8/103 |
| 4,399,049 | * | 8/1983 | Gray et al. | 252/91 |
| 4,417,994 | * | 11/1983 | Stoddart | 252/135 |
| 4,648,992 | * | 3/1987 | Graf et al. | 540/124 |
| 4,762,636 | * | 8/1988 | Balliello et al. | 252/95 |
| 4,990,280 | * | 2/1991 | Thorengaard et al. | 252/95 |
| 5,030,244 | * | 7/1991 | Neumann et al. | 8/526 |
| 5,847,114 | | 12/1998 | Thetford et al. | 540/140 |
| 5,916,481 | * | 6/1999 | Willey | 252/186.21 |

FOREIGN PATENT DOCUMENTS

| | | |
|---|---|---|
| 659082 | 12/1986 | (CH) . |
| 0333270 | 8/1994 | (EP) . |
| 0899325 | 3/1999 | (EP) . |
| 96/06906 | 3/1996 | (WO) . |
| 97/05202 | 2/1997 | (WO) . |

OTHER PUBLICATIONS

Abstract for CH 659082.

* cited by examiner

*Primary Examiner*—Yogendra N. Gupta
*Assistant Examiner*—John M Petruncio
(74) *Attorney, Agent, or Firm*—Kevin T. Mansfield

(57) ABSTRACT

Water-soluble granules of phthalocyanine compounds comprising a) from 2 to 50% by weight of a water-soluble phthalocyanine compound,
b) from 10 to 95% by weight of an anionic dispersing agent,
c) from 0 to 25% by weight of a water-soluble organic polymer,
d) from 0 to 10% by weight of a further additive and
e) from 3 to 15% by weight of water, based on the total weight of the granules, are described.

The granules are suitable especially as additives to washing agents for textile materials.

23 Claims, No Drawings

WATER-SOLUBLE GRANULES OF PHTHALOCYANINE COMPOUNDS

The present invention relates to water-soluble granules of phthalocyanine compounds, to a method of producing them, and to the use thereof in washing agent preparations.

Water-soluble phthalocyanine dyes, especially zinc and aluminum phthalocyanine-sulfonates, are frequently used as photoactivators in washing agent preparations. In view of the fact that such photoactivators dissolve too slowly in water, problems often arise, especially when there is inadequate mixing of the washing liquor, because the coloured photoactivators stain the laundry.

Solid microcapsules of phthalocyanine photoactivators that contain at least 38% of an encapsulating material have already been described in EP-B-0 333 270, but those microcapsules are also not able to satisfy all of the consumer's requirements in terms of dissolving behaviour and staining of the laundry.

It has now been found that, surprisingly, granules comprising a water-soluble phthalocyanine compound, an anionic dispersing agent and a maximum of 25% by weight of an organic polymer are distinguished by a high rate of dissolution in water, with the result that the problems mentioned above are substantially or entirely eliminated. A further advantage of such granules is that, even in the case of prolonged contact with a non-ionic surfactant, the phthalocyanine compound is not dissolved out of the granules and the laundry is not stained.

The present invention accordingly relates to water-soluble granules of phthalocyanine compounds comprising a) from 2 to 50% by weight of a water-soluble phthalocyanine compound,
b) from 10 to 95% by weight of an anionic dispersing agent,
c) from 0 to 25% by weight of a water-soluble organic polymer,
d) from 0 to 10% by weight of a further additive and
e) from 3 to 15% by weight of water, based on the total weight of the granules.

There come into consideration as the phthalocyanine compound for the granules according to the invention phthalocyanine complexes having a di-, tri- or tetra-valent metal (complexes having a $d^0$ or $d^{10}$ configuration) as the central atom. Such complexes are especially water-soluble Zn, Fe(II), Ca, Mg, Na, K, Al, Si(IV), P(V), Ti(IV), Ge(IV), Cr(VI), Ga(III), Zr(IV), In(III), Sn(IV) and Hf(VI) phthalocyanines, aluminum phthalocyanine and zinc phthalocyanine being especially preferred.

Advantageously, the composition according to the invention comprises a phthalocyanine compound of formula $$[Me]_q—[PC]—[Q_1]_r^- A_s^- \quad (1a)$$

or $$[Me]_q—[PC]—[Q_2]_r \quad (1b)$$

wherein

PC is the phthalocyanine ring system;

Me is Zn, Fe(II), Ca, Mg, Na, K, Al—$Z_1$, Si(IV), P(V), Ti(IV), Ge(IV), Cr(VI), Ga(III), Zr(IV), In(III), Sn(IV) or Hf(VI);

$Z_1$ is a halide, sulfate, nitrate, acetate or hydroxy ion;

q is 0, 1 or 2;

r is from 1 to 4;

$Q_1$ is a sulfo or carboxyl group; or a radical of the formula $$—SO_2X_2—R_6—X_3^+;\ —O—R_6—X_3^+;\ \text{or}\ —(CH_2)_t—Y_1^+;$$

wherein $R_6$ is branched or unbranched $C_1$–$C_8$alkylene; or 1,3- or 1,4-phenylene;

$X_2$ is —NH—; or —N—$C_1$—$C_5$alkyl-;

$X_3^+$ is a group of the formula

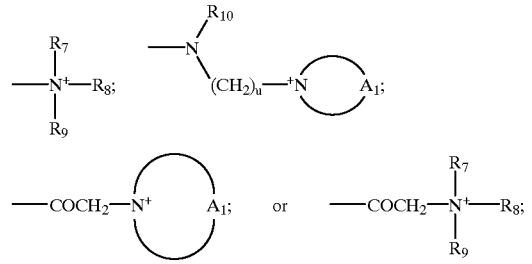

and, in the case where $R_6$=$C_1$–$C_8$alkylene, may also be a group of the formula

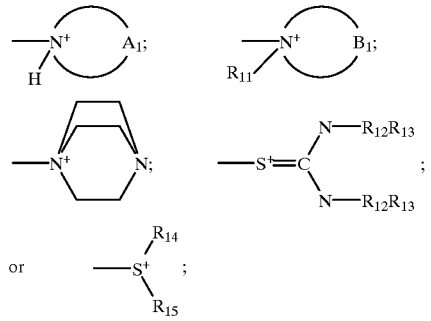

$Y_1^+$ is a group of the formula

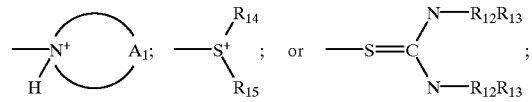

t is 0 or 1;

and in the above formulae $R_7$ and $R_8$ are each independently of the other $C_1$–$C_6$alkyl;

$R_9$ is $C_1$–$C_6$alkyl; $C_5$–$C_7$cycloalkyl; or $NR_{11}R_{12}$;

$R_{10}$ and $R_{11}$ are each independently of the other $C_1$–$C_5$alkyl;

$R_{12}$ and $R_{13}$ are each independently of the other hydrogen or $C_1$–$C_5$alkyl;

$R_{14}$ and $R_{15}$ are each independently of the other unsubstituted $C_1$–$C_6$alkyl or $C_1$–$C_6$alkyl substituted by hydroxy, cyano, carboxy, $C_1$–$C_6$alkoxycarbonyl, $C_1$–$C_6$alkoxy, phenyl, naphthyl or by pyridyl;

u is from 1 to 6;

$A_1$ is the balance of an aromatic 5- to 7-membered nitrogen heterocycle which may contain one or two further nitrogen atoms as ring members, and $B_1$ is the balance of a saturated 5- to 7-meambered nitrogen heterocycle which may contain 1 or 2 further nitrogen, oxygen and/or sulfur atoms as ring members;

$Q_2$ is hydroxy; $C_1$–$C_{22}$alkyl; branched $C_4$–$C_{22}$alkyl; $C_2$–$C_{22}$alkenyl; branched $C_4$–$C_{22}$alkenyl or a mixture thereof; $C_1$–$C_{22}$alkoxy; a sulfo or carboxyl radical; a radical of the formula

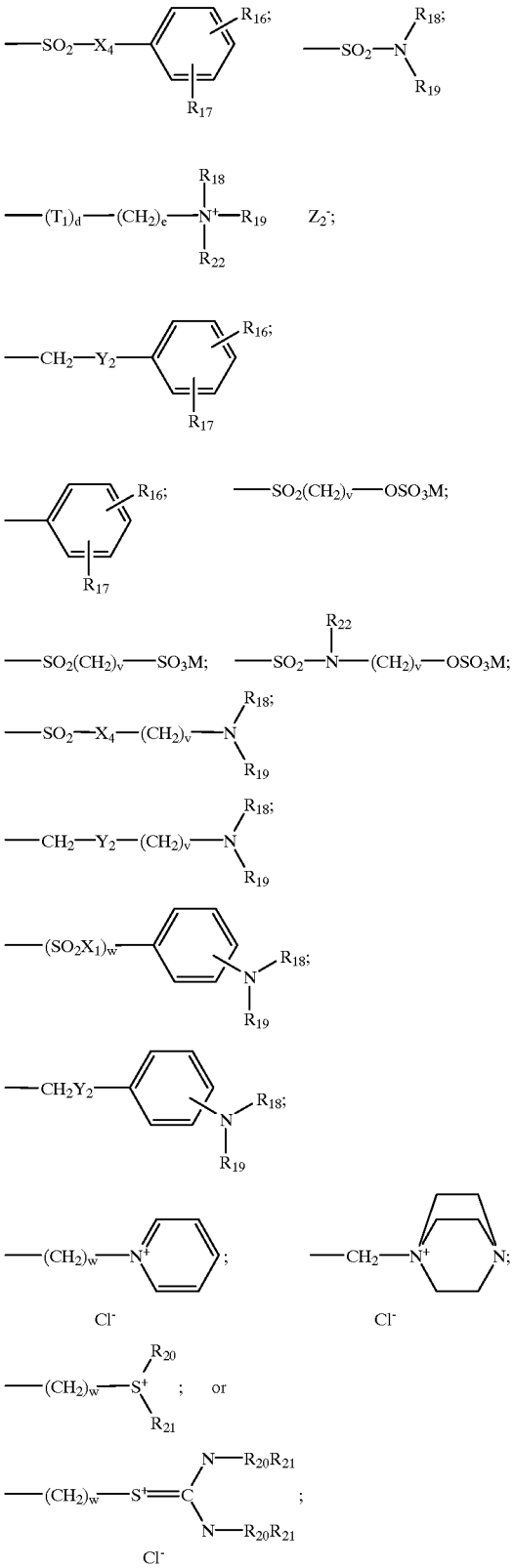

a branched alkoxy radical of the formula

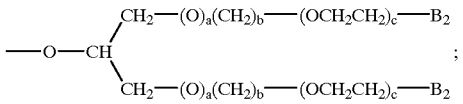

or

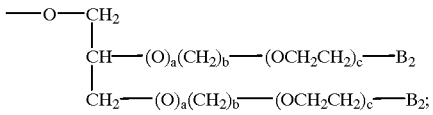

an alkylethyleneoxy unit of the formula $—(T_1)_d—(CH_2)_b(OCH_2CH_2)_a—B_3$ or an ester of the formula $COOR_{23}$, in which formulae $B_2$ is hydrogen; hydroxy; $C_1$–$C_{30}$alkyl; $C_1$–$C_{30}$alkoxy; $—CO_2H$; $—CH_2COOH$; $SO_3^-M_1^+$; $—OSO_3^-M_1^+$; $—PO_3^{2-}$; $M_1$; $—OPO_3^{2-}M_1$; or a mixture thereof;

$B_3$ is hydrogen; hydroxy; —COOH; $—SO_3^-M_1^+$; $—OSO_3^-M_1^+$; or $C_1$–$C_6$alkoxy;

$M_1$ is a water-soluble cation;

$T_1$ is —O—; or —NH—;

$X_1$ and $X_4$ are each independently of the other —O—; —NH—; or —N—$C_1$–$C_5$alkyl;

$R_{16}$ and $R_{17}$ are each independently of the other hydrogen, a sulfo group or a salt thereof, a carboxyl group or a salt thereof, or a hydroxyl group, at least one of the radicals $R_{16}$ and $R_{17}$ being a sulfo or carboxyl group or a salt thereof, $Y_2$ is —O—, —S—, —NH— or —N—$C_1$–$C_5$alkyl;

$R_{18}$ and $R_{19}$ are each independently of the other hydrogen, $C_1$–$C_6$alkyl, hydroxy-$C_1$–$C_6$alkyl, cyano-$C_1$–$C_6$alkyl, sulfo-$C_1$–$C_6$alkyl, carboxy or halo-$C_1$–$C_6$alkyl; unsubstituted phenyl; or phenyl substituted by halogen, $C_1$–$C_4$alkyl or $C_1$–$C_4$alkoxy, sulfo or by carboxy; or $R_{18}$ and $R_{19}$, together with the nitrogen atom to which they are bonded, form a saturated 5- or 6-membered heterocyclic ring that may in addition contain a further nitrogen atom or an oxygen atom as ring member;

$R_{20}$ and $R_{21}$ are each independently of the other a $C_1$–$C_6$alkyl or aryl-$C_1$–$C_6$alkyl radical;

$R_{22}$ is hydrogen; unsubstituted $C_1$–$C_6$alkyl; or $C_1$–$C_6$alkyl substituted by halogen, hydroxy, cyano, phenyl, carboxy, $C_1$–$C_6$alkoxycarbonyl or by $C_1$–$C_6$alkoxy;

$R_{23}$ is $C_1$–$C_{22}$alkyl, branched $C_4$–$C_{22}$alkyl, $C_1$–$C_{22}$alkenyl or branched $C_4$–$C_{22}$alkenyl; $C_3$–$C_{22}$-glycol; $C_1$–$C_{22}$alkoxy; branched $C_4$–$C_{22}$alkoxy; or a mixture thereof;

M is hydrogen; or an alkali metal ion or ammonium ion;

$Z_2$ is a chlorine, bromine, alkyl sulfate or aralkyl sulfate ion;

a is 0 or 1;

b is from 0 to 6;

c is from 0 to 100;

d is 0; or 1;

e is from 0 to 22;

v is an integer from 2 to 12;

w is 0 or 1; and

A is an organic or inorganic anion, and s in the case of monovalent anions $A^-$ is equal to r and in the case of polyvalent anions is $\leqq r$, it being necessary for $A_s^-$ to balance the positive charge; and when $r \neq 1$, the radicals $Q_1$ may be identical or different, and wherein the phthalocyanine ring system may also comprise further solubilising groups.

The number of substituents $Q_1$ and $Q_2$ in formula (1a) and in formula (1b), respectively, which substituents may be identical or different, is from 1 to 8 and, as is customary with phthalocyanines, the number need not be a whole number (degree of substitution). If other, non-cationic substituents are also present, the sum of the latter and the cationic substituents is from 1 to 4. The minimum number of substituents that have to be present in the molecule is governed by the water-solubility of the resulting molecule. An adequate solubility is achieved when the amount of phthalocyanine compound that dissolves is sufficient to cause a photodynamically catalysed oxidation on the fibres. A solubility of as low as 0.01 mg/l may be sufficient, but generally a solubility of from 0.001 to 1 g/l is expedient.

Halogen is fluorine, bromine or, especially, chlorine.

There come into consideration as

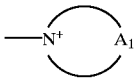

groups especially:

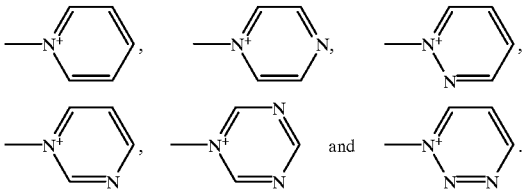

The group

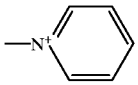

is preferred.

The above-listed groups likewise come into consideration as heterocyclic rings in the group

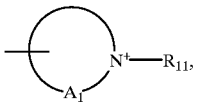

only the bond to the remaining substituents being effected by way of a carbon atom.

In all substituents, phenyl, naphthyl and aromatic hetero rings may be substituted by one or two further radicals, for example by $C_1$–$C_6$alkyl, $C_1$–$C_6$alkoxy, halogen, carboxy, $C_1$–$C_6$alkoxy-carbonyl, hydroxy, amino, cyano, sulfo, sulfonamido etc.

A substituent from the group $C_1$–$C_6$alkyl, $C_1$–$C_6$alkoxy, halogen, carboxy, $C_1$–$C_6$alkoxycarbonyl and hydroxy is preferred.

There come into consideration as the

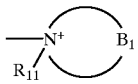

group especially:

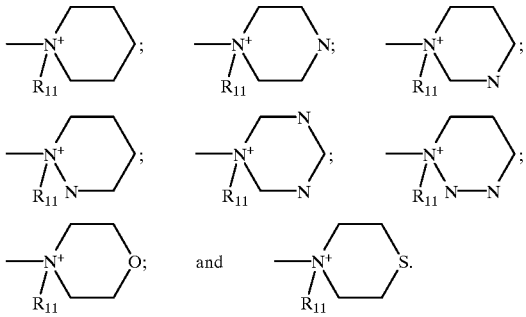

All of the above-mentioned nitrogen heterocycles may in addition be substituted by alkyl groups, either at a carbon atom or at a further nitrogen atom located in the ring, in which case the methyl group is preferred as alkyl group.

$A_s^-$ in formula (1a) denotes, as counterion to the positive charge of the remainder of the molecule, any desired anion. It is generally introduced by the preparation process (quaternisation), in which case it is preferably a halogen ion, an alkyl sulfate ion or an aryl sulfate ion. Among the aryl sulfate ions mention should be made of the phenylsulfonate, p-tolylsulfonate and p-chlorophenylsulfonate ions. It is also possible, however, for any other anion to function as the anion, since the anions can readily be interchanged in known manner; $A_s^-$may also be a sulfate, sulfite, carbonate, phosphate, nitrate, acetate, oxalate, citrate or lactate ion or another anion of an organic carboxylic acid. In the case of mono-valent anions, the index s is equal to r. In the case of polyvalent anions, s assumes a value $\leqq r$, but depending on the conditions must be such that it exactly balances the positive charge of the remainder of the molecule.

$C_1$–$C_6$Alkyl and $C_1$–$C_6$alkoxy are straight-chain or branched alkyl and alkoxy radicals, respectively, such as, for example, methyl, ethyl, n-propyl, isopropyl, n-butyl, sec-butyl, tert-butyl, amyl, isoamyl, tert-amyl or hexyl and methoxy, ethoxy, n-propoxy, isopropoxy, n-butoxy, sec-butoxy, tert-butoxy, amyloxy, isoamyloxy, tert-amyloxy or hexyloxy, respectively.

$C_2$–$C_{22}$Alkenyl is, for example, allyl, methallyl, isopropenyl, 2-butenyl, 3-butenyl, isobutenyl, n-penta-2,4-dienyl, 3-methylbut-2-enyl, n-oct-2-enyl, n-dodec-2-enyl, isododecenyl, n-dodec-2-enyl or n-octadec-4-enyl.

Preferred phthalocyanine compounds of formula (1a) for the granules according to the invention correspond to formula (2a)

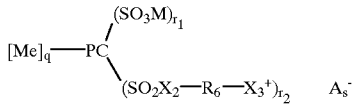

wherein

Me, q, PC, $X_2$, $X_3$ and $R_6$ are as defined for formula (1a);

M is hydrogen, or an alkali metal, ammonium or amine salt ion;

and the sum of the numbers $r_1$ and $r_2$ is from 1 to 4, and $A_s^-$ exactly balances the positive charge of the remainder of the molecule, and correspond especially to formula $$[Me]_q—[PC]—[SO_2NHR_6'—X_3'^+A'^-]_r \quad (3)$$

wherein

Me, q and PC are as defined for formula (1a);

$R_6'$ is $C_2$–$C_6$alkylene;

$r_1$ is a number from 1 to 4;

$X_3'$ is a group of the formula

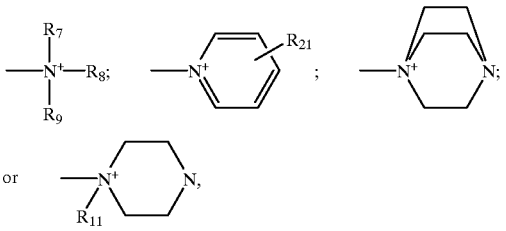

or

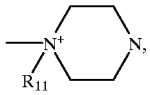

in which formulae $R_7$ and $R_8$ are each independently of the other unsubstituted $C_1$–$C_4$alkyl or $C_1$–$C_4$alkyl substituted by hydroxy, cyano, halogen or by phenyl;

$R_9$ is $R_7$; cyclohexyl or amino;

$R_{11}$ is $C_1$–$C_4$alkyl;

$R_{21}$ is $C_1$–$C_4$alkyl; $C_1$–$C_4$alkoxy; halogen, carboxy, $C_1$–$C_4$alkoxycarbonyl or hydroxy; and A' is a halide, alkyl sulfate or aryl sulfate ion;

wherein the radicals $—SO_2NHR'_6—X_3'^+A^-$ may be identical or different.

Further phthalocyanine compounds that can be used in accordance with the invention correspond to formula $$[Me]_q[PC][SO_3—Y_3']_r \quad (4)$$

wherein

PC is the phthalocyanine ring system;

Me is Zn, Fe(II), Ca, Mg, Na, K, Al—$Z_1$, Si(IV), P(V), Ti(IV), Ge(IV), Cr(VI), Ga(III), Zr(IV), In(III), Sn(IV) or Hf(VI);

$Z_1$ is a halide, sulfate, nitrate, acetate or hydroxy ion;

q is 0; 1; or 2;

$Y_3'$ is hydrogen, an alkali metal ion or an ammonium ion; and r is any number from 1 to 4.

Special preference is given to those phthalocyanine compounds of formula (4) wherein Me is Zn or Al—$Z_1$; and $Z_1$ is a halide, sulfate, nitrate, acetate or hydroxy ion.

Further phthalocyanine compounds of interest that can be used in accordance with the invention correspond to formula (5)

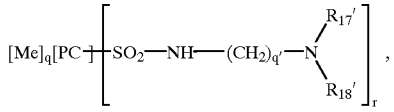

wherein

PC, Me and q are as defined for formula (4);

$R_{17}'$ and $R_{18}'$ are each independently of the other hydrogen, phenyl, sulfophenyl, carboxyphenyl, $C_1$–$C_6$alkyl, hydroxy-$C_1$–$C_6$alkyl, cyano-$C_1$–$C_6$alkyl, sulfo-$C_1$–$C_6$alkyl, carboxy-$C_1$–$C_6$alkyl or halo-$C_1$–$C_6$alkyl or, together with the nitrogen atom, form a morpholine ring;

q' is an integer from 2 to 6; and r is a number from 1 to 4;

wherein, when r>1, the radicals

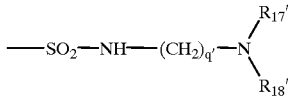

present in the molecule may be identical or different.

Further phthalocyanine compounds of interest that can be used in accordance with the invention correspond to formula (6)

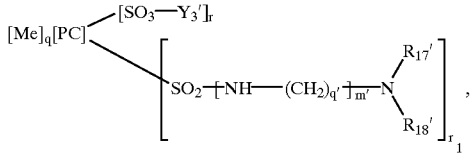

wherein

PC, Me and q are as defined for formula (4);

$Y'_3$ is hydrogen, an alkali metal ion or an ammonium ion;

q' is an integer from 2 to 6;

$R_{17}'$ and $R_{18}'$ are each independently of the other hydrogen, phenyl, sulfophenyl, carboxyphenyl, $C_1$–$C_6$alkyl, hydroxy-$C_1$–$C_6$alkyl, cyano-$C_1$–$C_6$alkyl, sulfo-$C_1$–$C_6$alkyl, carboxy-$C_1$–$C_6$alkyl or halo-$C_1$–$C_6$alkyl or, together with the nitrogen atom, form a morpholine ring, m' is 0 or 1; and r and $r_1$ are each independently of the other any number from 0.5 to 3.5, the sum $r+r_1$ being a minimum of 1 and a maximum of 4.

Where the central atom Me in the phthalocyranine ring is Si(IV), the phthalocyanines used in accordance with the invention may contain, in addition to the substituents on the phenyl nucleus of the phthalocyanine ring, also axial substituents (=$R_{24}$). Such phthalocyanines correspond, for example, to formula (7)

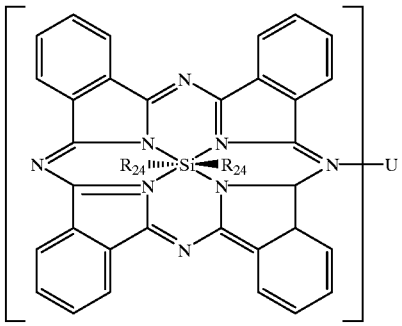

wherein $R_{24}$ is hydroxy; $C_1$–$C_{22}$alkyl; branched $C_4$–$C_{22}$alkyl; $C_1$–$C_{22}$alkenyl; branched $C_4$–$C_{22}$alkenyl or a mixture thereof; $C_1$–$C_{22}$alkoxy; a sulfo or carboxyl radical, a radical of the formula

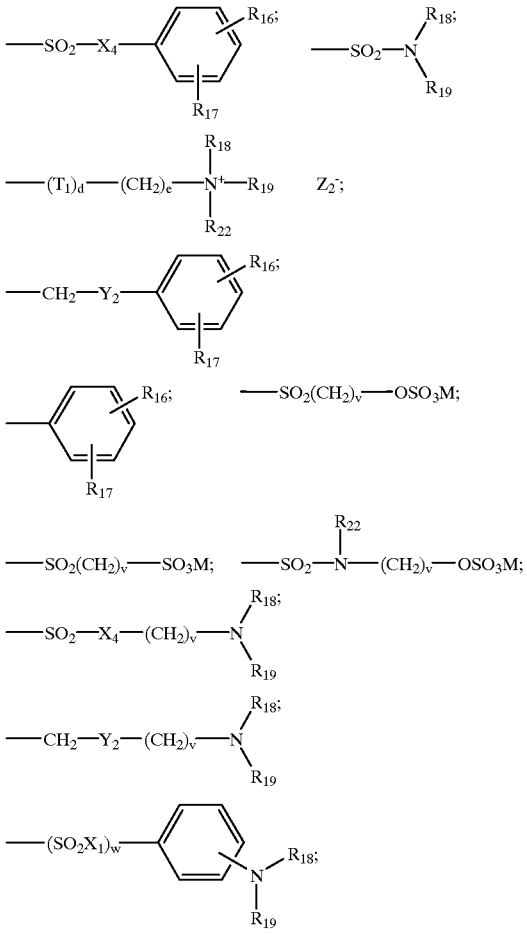

-continued

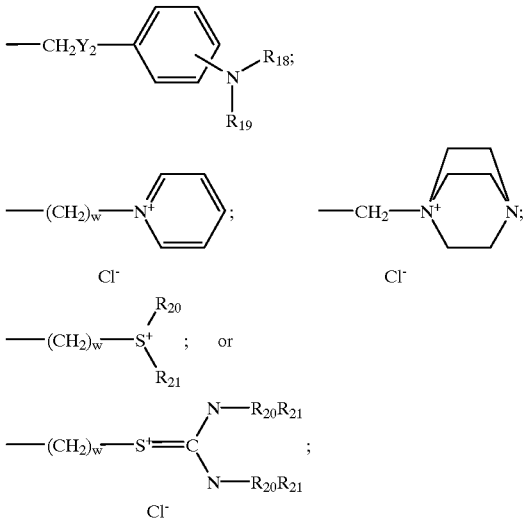

a branched alkoxy radical of the formula

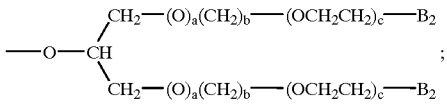

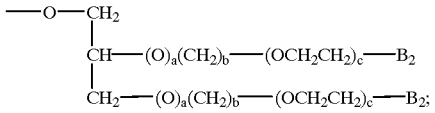

or an alkylethyleneoxy unit of the formula $—(T_1)_d—(CH_2)_b(OCH_2CH_2)_a—B_3$ or an ester of the formula $COOR_{23}$; and U is $[Q_1]_r^-A_s^+$; or $Q_2$.

$R_{16}$, $R_{17}$, $R_{18}$, $R_{19}$, $R_{20}$, $R_{21}$, $R_{22}$, $R_{23}$, $B_2$, $B_3$, M, $M_1$, $Q_1$, $Q_2$, $A_s$, $T_1$, $X_1$, $Y_2$, $Z_2$, a, b, c, d, e, r, v and w in the above formulae are as defined for formulae (1a) and (1b).

Especially preferred as phthalocyanine compound are compounds such as those commercially available and used in washing agents. Usually, the anionic phthalocyanine compounds are in the form of alkali metal salts, especially sodium salts.

Preferred formulations of the granules contain from 4 to 30% by weight, especially from 5 to 20% by weight, of phthalocyanine compound, based on the total weight of the granules.

It will be understood that it is also possible to use mixtures of two or more phthalocyanine compounds instead of a single, homogeneous phthalocyanine compound.

The anionic dispersing agents used are, for example, the commercially available water-soluble anionic dispersing agents for dyes, pigments etc. The following products, especially, come into consideration: condensation products of aromatic sulfonic acids and formaldehyde, condensation products of aromatic sulfonic acids with unsubstituted or chlorinated diphenylene or diphenyl oxides and optionally form-aldehyde, (mono-/di-)alkylnaphthalenesulfonates, sodium salts of polymerised organic sulfonic acids, sodium salts of polymerised alkylnaphthalenesulfonic acids, sodium salts of polymerised alkylbenzenesulfonic acids, alkylarylsulfonates, sodium salts of alkyl polyglycol ether sulfates, polyalkylated polynuclear arylsulfonates, methylene-linked condensation products of arylsulfonic acids and hydroxyarylsulfonic acids, sodium salt of dialkylsulfosuccinic acid, sodium salts of alkyl diglycol ether sulfates, sodium salts of polynaphthalenemethanesulfonates, ligno- or oxylignosulfonates or heterocyclic polysulfonic acids.

The dispersing agents may be used individually or in the form of a mixture of two or more dispersing agents.

Especially suitable anionic dispersing agents are condensation products of naphthalene-sulfonic acids with formaldehyde, sodium salts of polymerised organic sulfonic acids, (mono-/di-)alkylnaphthalenesulfonates, polyalkylated polynuclear aryl sulfonates, sodium salts of polymerised alkylbenzenesulfonic acid, lignosulfonates, oxylignosulfonates and condensation products of naphthalenesulfonic acid with a polychloromethyldiphenyl.

Preferably, the granules according to the invention contain from 40 to 90% by weight, especially from 50 to 90% by weight, of anionic dispersing agent. In addition to the water-soluble phthalocyanine compound and the anionic dispersing agent, the granules according to the invention may comprise a water-soluble organic polymer. Such polymers may be used individually or in the form of a mixture of two or more polymers. Preferably, such a polymer is added for the purpose of improving the mechanic stability of the granules and/or when, during later use of the granules in a washing agent, the phthalocyanine compound is to be prevented from being dissolved out of the granules by a non-ionic surfactant.

There come into consideration as water-soluble polymers, for example, gelatin, poly-acrylates, polymethacrylates, copolymers of ethyl acetate, methyl methacrylate and methacrylic acid (ammonium salt), polyvinylpyrrolidones, vinylpyrrolidones, vinyl acetates, copolymers of vinylpyrrolidone with long-chained a-olefins, poly (vinylpyrrolidone/dimethylaminoethyl methacrylates), copolymers of vinylpyrrolidone/dimethylaminopropyl methacrylamides, copolymers of vinylpyrrolidonedimethylaminopropyl acrylamides, quaternised copolymers of vinylpyrrolidones and dimethylaminoethyl methacrylates, terpolymers of vinylcaprolactamvinylpyrrolidonedimethylaminoethyl methacrylates, copolymers of vinylpyrrolidone and methacrylamidopropyltrimethylammonium chloride, terpolymers of caprolactamvinylpyrrolidonedimethylaminoethyl methacrylates, copolymers of styrene and acrylic acid, polycarboxylic acids, polyacrylamides, carboxymethylcellulose, hydroxymethylcellulose, polyvinyl alcohols, polyvinyl acetate, hydrolysed polyvinyl acetate, copolymers of maleic acid with unsaturated hydrocarbons, and mixed polymerisation products of the mentioned polymers.

Of those organic polymers, carboxymethylcellulose, polyacrylamides, polyvinyl alcohols, polyvinylpyrrolidones, gelatin, hydrolysed polyvinyl acetates, copolymers of vinylpyrrolidone and vinyl acetate, and also polyacrylates and polymethacrylates, are especially preferred.

The organic polymers are used in an amount of from 0 to 25% by weight, preferably from 5 to 20% by weight and, especially, from 8 to 18% by weight, based on the total weight of the granules.

The granules according to the invention may comprise further additives, for example wetting agents, water-insoluble or water-soluble dyes or pigments, and also dissolution accelerators and optical brighteners. Such additives are present in an amount of from 0 to 10% by weight, based on the total weight of the granules.

The granules according to the invention are produced, for example, in the following manner: first of all an aqueous solution of the phthalocyanine dye is prepared, the anionic dispersing agent and, if desired, further additives are added thereto, and the mixture is stirred, where appropriate with heating, until a homogeneous solution is obtained. The solids content of the solution should preferably be at least 30% by weight, especially from 40 to 50% by weight, based on the total weight of the solution. The viscosity of the solution is preferably less than 200 mPas.

The aqueous solution comprising the phthalocyanine dye and the anionic dispersing agent is then subjected to a drying step in which all water, with the exception of a residual amount, is removed, solid particles (granules) simultaneously being formed. Known methods are suitable for producing the granules from the aqueous solution. In principle, both continuous methods and discontinuous methods are suitable. Continuous methods are preferred, especially spray-drying and fluidized bed granulation processes.

Especially suitable are spray-drying processes in which the active ingredient solution is sprayed into a chamber with circulating hot air. The atomisation of the solution is carried out using unitary or binary nozzles or is brought about by the spinning effect of a rapidly rotating disc. In order to increase the particle size, the spray-draying process may be combined with an additional agglomeration of the liquid particles with solid nuclei in a fluidized bed that forms an integral part of the chamber (so-called fluidized spray dryer). The fine particles (<100 $\mu$m) obtained by a conventional spray-drying process may, if necessary after being separated from the exhaust gas flow, be fed without being further treated directly into the atomizing cone of the atomiser of the spray dryer as nuclei, for the purpose of agglomeration with the liquid droplets of the active ingredient.

During the granulation step, the water can rapidly be removed from the solutions comprising phthalocyanine compound, anionic dispersing agent and possibly organic polymer and further additives, and it is expressly intended that agglomeration of the droplets forming in the atomising cone, i.e. the agglomeration of, droplets with solid particles, will take place.

If necessary, the granules formed in the spray-dryer are removed in a continuous process, for example by a sieving operation. The fines and the oversize particles are either recycled directly to the process (without being redissolved) or are dissolved in the liquid active ingredient formulation and subsequently granulated again.

The granules according to the invention are resistant to abrasion, low in dust, free-flowing and can readily be metered. They are distinguished in particular by very rapid solubility in water. They are used especially in washing agent formulations. They may be added in the desired concentration of the phthalocyanine compound directly to a washing agent formulation. The present invention relates also to that use.

Where the dark appearance of the granules in the washing agent is to be suppressed, this can be achieved, for example, by embedding the granules in a droplet of a whitish meltable substance ("water-soluble wax") or, preferably, by encapsulating the granules in a melt consisting, for example, of a water-soluble wax, as described in EP-B-0 323 407 B1, a white solid (e.g. titanium dioxide) being added to the melt in order to reinforce the masking effect of the capsule.

The present invention accordingly relates also to washing agent formulations comprising I) from 5 to 70% A) of an anionic surfactant and/or B) of a non-ionic surfactant, II) from 5 to 50% C) of a builder substance, III) from 1 to 12% D) of a peroxide and, where appropriate, a catalyst and IV) from 0.01 to 1% E) of granules according to the invention, the percentages in each case being percentages by weight, based on the total weight of the washing agent.

Preference is given to washing agent formulations comprising

I) from 5 to 70% A) of an anionic surfactant: and/or B) of a non-ionic surfactant, II) from 5 to 40% C) of a builder substance.

III) from 1 to 12% D) of a peroxide and, where appropriate, a catalyst and

IV) from 0.01 to 0.5% E) of granules according to the invention, the percentages in each case being percentages by weight, based on the total weight of the washing agent.

The washing agent may be in solid or liquid form, for example in the form of a liquid non-aqueous washing agent containing not more than 5% by weight, preferably from 0 to 1% by weight, of water, and may have as base a suspension of a builder substance in a non-ionic surfactant, for example as described in GB-A-2 158 454.

Preferably, however, the washing agent is in the form of a powder or granules, which can be produced, for example, by first of all preparing a starting powder by spray-drying an aqueous suspension containing all of the components listed above with the exception of components D) and E), and then adding the dry components D) and E) and mixing everything together.

It is also possible to start with an aqueous suspension that contains components A) and C), but not component B) or only some of component B). The suspension is spray-dried, then component E) is mixed with component B) and the mixture is added to the suspension, and subsequently component D) is admixed dry.

Preferably, the components are mixed with one another in such amounts that a solid compact washing agent in the form of granules is obtained that has a specific weight of at least 500 g/l.

In another preferred embodiment, the production of the washing agent is carried out in three steps. In the first step a mixture of anionic surfactant (and, where appropriate, a small amount of non-ionic surfactant) and builder substance is prepared. In the second step that mixture is sprayed with the major portion of the non-ionic surfactant and then, in the third step, peroxide, where appropriate catalyst, and the granules according to the invention are added. That method is usually carried out in a fluidized bed.

In a further preferred embodiment, the individual steps are not carried out completely separately, so that there is a certain amount of overlap between them. Such a method is usually carried out in an extruder, in order to obtain granules in the form of megapearls.

The anionic surfactant A) may be, for example, a sulfate, sulfonate or carboxylate surfactant or a mixture of those surfactants.

Preferred sulfates are those having from 12 to 22 carbon atoms in the alkyl radical, where appropriate in combination with alkyl ethoxysulfates having from 10 to 20 carbon atoms in the alkyl radical.

Preferred sulfonates are, for example, alkylbenzenesulfonates having from 9 to 15 carbon atoms in the alkyl radical and/or alkyl naphthialenesulfonates having from 6 to 16 carbon atoms in the alkyl radical in question.

The cation in the anionic surfactant is prefenably an alkali metal cation, especially sodium.

Preferred carboxylates are alkali metal sarcosinates of the formula R—CO—N($R^1$)—$CH_2COOM^1$, wherein R is alkyl or alkenyl having from 8 to 18 carbon atoms in the alkyl or alkenyl radical, $R^1$ is $C_1$–$C_4$alkyl and $M^1$ is an alkali metal.

The non-ionic surfactant B) may be, for example, a condensation product of from 3 to 8 mols of ethylene oxide with 1 mol of primary alcohol that contains from 9 to 15 carbon atoms.

There come into consideration as builder substance C), for example, alkali metal phosphates, especially tripolyphosphates, carbonates or hydrogen carbonates, especially the sodium salts, silicates, aluminum silicates, polycarboxylates, polycarboxylic acids, organic phosphonates, aminoalkylenepoly(alkylenephosphonates) or mixtures of those compounds.

Especially suitable silicates are sodium salts, of crystalline silicates having layered structures of the formula $NaHSi_tO_{2t+1}\cdot pH_2O$ or $Na_2Si_tO_{2t+1}\cdot pH_2O$, wherein t is a number from 1.9 to 4 and p is a number from 0 to 20.

Among the aluminum silicates, preference is given to those obtainable commercially under the names zeolite A, B, X and HS, and also to mixtures comprising two or more of those components.

Among the polycarboxylates, preference is given to polyhydroxycarboxylates, especially citrates, and acrylates and also copolymers thereof with maleic anhydride.

Preferred polycarboxylic acids are nitrilotriacetic acid, ethylenediaminetetraacetic acid and ethylenediamine disuccinate either in racemic form or in the enantiomerically pure S,S form.

Phosphonates or aminoalkylenepoly (alkylenephosphonates) that are especially suitable are alkali metal salts of 1-hydroxyethane-1,1-diphosphonic acid, nitrilotris(methylenephosphonic acid), ethylenediaminetetramethylene.phosphonic acid and diethylenetriaminepentamethylenephosphonic acid.

There come into consideration as the peroxide component D), for example, the organic and inorganic peroxides known in the literature and available commercially that bleach textile materials at conventional washing temperatures, for example at from 10 to 950° C.

The organic peroxides are, for example, mono- or polyperoxides, especially organic peracids or salts thereof, such as phthalimidoperoxycaproic acid, peroxybenzoic acid, diperoxydodecanoic diacid, diperoxynonanoic diacid, diperoxydecanoic diacid, diperoxyphthalic acid or salts thereof.

Preferably, however, inorganic peroxides are used, such as, for example, persulfates, perborates, percarbonates and/or persilicates. It will be understood that mixtures of inorganic and/or organic peroxides can also be used. The peroxides may be in a variety of crystalline forms and have different water contents, and they may also be used together with other inorganic or organic compounds in order to improve their storage stability.

The peroxides are added to the washing agent preferably by mixing the components, for example using a screw metering system and/or a fluidized bed mixer.

The washing agents may comprise, in addition to the combination according to the invention, one or more optical brighteners, for example from the class bis-triazinylaminostilbenedisulfonic acid, bis-triazolylstilbenedisulfonic acid, bis-styrylbiphenyl or bis-benzofuranylbiphenyl, a bis-benzoxalyl derivative, bisbenzimidazolyl derivative or coumarin derivative or a pyrazoline derivative.

The washing agent may also comprise suspending agents for dirt, e.g. sodium carboxymethylcellulose, pH regulators, e.g. alkali metal or alkaline earth metal silicates, foam regulators, e.g. soap, salts for regulating the spray-drying and the granulating properties, e.g. sodium sulfate, perfumes and, optionally, antistatic agents and softeners, enzymes, such as amylase, bleaches, pigments and/or toning agents. It will be understood that such constituents must be stable towards the bleaching agent used.

Further preferred additives to the washing agents according to the invention are polymers which, during the washing of textiles, prevent staining caused by dyes in the washing liquor which have been released from the textiles under the washing conditions. Such polymers are preferably polyvinylpyrrolidones which, where appropriate, have been modified by the incorporation of anionic or cationic substituents, especially those having a molecular weight in the range from 5000 to 60 000, more especially from 10 000 to 50 000.Such polymers are preferably used in an amount of from 0.05 to 5% by weight, especially from 0.2 to 1.7% by weight, based on the total weight of the washing agent.

In addition, the washing agents according to the invention may also comprise so-called perborate activators, such as, for example, TAED or TAGU. Preference is given to TAED, which is preferably used in an amount of from 0.05 to 5% by weight, especially from 0.2 to 1.7% by weight, based on the total weight of the washing agent.

The following Examples serve to illustrate the invention without limiting the invention thereto. Parts and percentages relate to weight, unless specified otherwise.

EXAMPLE 1

725 g of an aqueous solution of a zinc phthalocyanine compound (sodium salt of zinc phthalocyanine, containing 3 or 4 sulfo groups) having a solids content of 20% by weight are introduced into a glass beaker. 3010 g of an aqueous solution containing 40% by weight of an anionic dispersing agent (condensation product of naphthalenesulfonic acid and formaldehyde) are added to the first solution. The phthalocyaninedispersing agent mixture having a solids content of approximately 34% by weight is homogenised by stirring at 25° C. for 1 hour. The solution is then spray-dried in a spray dryer equipped with a unitary nozzle. The exhaust air temperature is 105° C. at a feed air temperature of 195° C. Free-flowing granules having an average particle size of 50 $\mu$m and a residual water content of 7% are obtained. The granules produced in that manner contain 10% zinc phthalocyanine.

EXAMPLES 2 TO 7

Granules having the following compositions are produced according to the same procedure: the phthalocyanines in Examples 2 to 48 each contain 3 or 4 sulfo groups and are in the form of sodium salts.

| Ex. No. | Dye | % by weight | Anionic dispersing agent | % by weight | Residual moisture in the granules |
|---|---|---|---|---|---|
| 2 | aluminium phthalo-cyanine | 15 | condensation product of formaldehyde with naphthalene-sulfonic acid | 80 weight | 5% by |

-continued

| Ex. No. | Dye | % by weight | Anionic dispersing agent | % by weight | Residual moisture in the granules |
|---|---|---|---|---|---|
| 3 | zinc phthalo-cyanine | 5 | sodium salt of polymerised alkyl-naphthalenesulfonic acid | 86 | 9% by weight |
| 4 | zinc phthalo-cyanine | 20 | oxylignosulfonate sodium salt | 76 | 4% by weight |
| 5 | aluminium phthalo-cyanine | 6 | heterocyclic poly-sulfonic acid | 78 | 6% by weight |
| 6 | zinc phthalo-cyanine | 9 | condensation product of formaldehyde with naphthalene-sulfonic acid | 82 | 9% by weight |
| 7 | zinc phthalo-cyanine | 10 | condensation product of formaldehyde with naphthalene-sulfonic acid | 56 | 5% by weight |
| | | | alkylnaphthalene-sulfonic acid sodium salt | 29 | |

EXAMPLE 8

880 g of an aqueous solution of an aluminum phthalocyanine compound (sodium salt of aluminum phthalocyanine, containing 3 or 4 sulfo groups) having a solids content of 25% by weight are introduced into a glass beaker and diluted with 1460 g of deionised water. The solution is heated to 45° C. and a dry, pulverulent anionic dispersing agent (condensation product of formaldehyde with naphthalenesulfonic acid) is introduced in portions into the heated solution. The dispersing-agent-containing phthalocyanine solution is then stirred at 45° C. for 2 hours in order that the dispersing agent is completely dissolved.

the finished phthalocyaninedispersing agent solution having a solids content of 45% is granulated while still warm in a bench fluidized spray dryer. In the first phase of that granulation procedure, the nuclei are formed in the fluidized bed ($T_{feed\ air}$=200° C., $T_{bed}$= 950° C.). Once enough nuclei are present in the fluidized bed for the granulation, the bed temperature is reduced to approximately 50° C. in order to initiate the granulation process. The granulation of the entire phthalocyanine solution is carried out at a fluidized bed temperature of from 48 to 51° C. The granules discharged from the granulator have a residual moisture content of approximately 14% by weight and are then dried to the desired value of 9% by weight in a continuously operating fluidized bed with air at a temperature of 750° C.

The free-flowing granules have an average particle size of 160 $\mu$m and contain 10% by weight aluminum phthalocyanine compound.

EXAMPLES 9 to 14

Granules having the following compositions are produced according to the same procedure:

| Ex. No. | Dye | % by weight | Anionic dispersing agent | % by weight | Residual moisture in the granules |
|---|---|---|---|---|---|
| 9 | zinc phthalo-cyanine | 14 | dialkyl naphthalene-sulfonate sodium salt | 80 | 6% by weight |
| 10 | zinc phthalo-cyanine | 10 | condensation product of formal-dehyde with naph-thalensulfonic acid | 85 | 5% by weight |
| 11 | aluminium phthalo-cyanine | 6 | naphthalenesulfonic acid sodium salt condensed with formaldehyde | 86 | 8% by weight |
| 12 | aluminium phthalo-cyanine | 12 | condensation pro-duct of sulfonated naphthalene with a polychloromethyl-diphenyl mixture | 82 | 4% by weight |
| 13 | aluminium phthalo-cyanine | 18 | dinaphthylmethane-sulfonic acid, sodium salt | 77 | 5% by weight |
| 14 | aluminium phthalo-cyanine | 14 | sodium lignosulfate dinaphthylmethane-sulfonic acid | 36 45 | 5% by weight |

EXAMPLE 15

The preparation of the phthalocyanine solution and the typical formulations of the phthalocyanine granules correspond to Examples 1 to 7. Unlike Example 1, the granulation is carried out in a spray dryer in which the fines produced during the process are continuously separated from the waste gas flow and are conveyed directly by a gas flow into the atomizing cone of the nozzle. The resulting granules have the same properties as those already described in Example 1. Their average particle size is 112 μm, so that they are obtained in a substantially coarser particle size than in Example 1. The product from this Example contains substantially less fine dust (max. 4.5% of particles<20 μm, compared with 15% by weight in Example 1).

EXAMPLE 16

512 g of an anionic dispersing agent (condensation product of formaldehyde with naphthalenesulfonic acid) and 1000 g of a further anionic dispersing agent (methylene-linked condensation product of arylsulfonic acids and hydroxyarylsulfonic acids) are dissolved in succession in 1980 g of a 10% aqueous solution of the zinc phthalocyanine compound from Example 1, which has been heated to 50° C. The aqueous phthalocyanine formulation is then stirred for 3 hours, in order that all components are completely dissolved. Some of the phthalocyanine solution is then dried in vacuo for 48 hours and the dry material is then ground in a mortar.

The ground product is subsequently introduced into a laboratory fluidized bed granulator (STREA-1; Aeromatic AG, Bubendorf, Switzerland) as granulation nuclei. The nuclei are fluidized with the hot air (approximately 65° C.) flowing into the granulator through the perforated base. The phthalocyanine solution is then sprayed continuously into the fluidized bed using a binary nozzle. After approximately 90 minutes, the granulation (metering in of the phthalocyanine solution) is terminated. Once the granulation is concluded the granules are dried in the same equipment, with air at a temperature of 80° C., to a residual water content of 5% by weight.

The particles are then discharged and the fines are removed by sieving. The average particle size is 380 μm.

EXAMPLES 17 TO 22

Granules having the following compositions are produced according to the same procedure as that in Example 16:

| Ex. No. | Dye | % by weight | Anionic dispersing agent | % by weight | Residual moisture in the granules |
|---|---|---|---|---|---|
| 17 | aluminium phthalo-cyanine | 6 | oxylignosulfonate sodium salt | 84 | 10% by weight |
| 18 | zinc phthalo-cyanine | 10 | condensation pro-duct of formalde hyde with naphtha-lenesulfonic acid | 85 | 5% by weight |
| 19 | aluminium phthalo-cyanine | 17 | alkyl polyglycol ether sulfate sodium salt | 79 | 4% by weight |
| 20 | alum-inium phthalo-cyanine | 9 | sodium lignosulfate | 82 | 9% by weight |
| 21 | zinc phthalo-cyanine | 15 | condensation pro-duct of sulfonated naphthalene with a polychloromethyl-diphenyl mixture | 77 | 8% by weight |
| 22 | aluminium phthalo-cyanine | 10 | lignosulfonate | 85 | 5% by weight |

EXAMPLE 23

826 g of a pulverulent dispersing agent (condensation product of formaldehyde with naphthalenesulfonic acid) are stirred into and dissolved in 1073 g of an aqueous solution of the zinc phthalocyanine compound from Example 1 having a solids content of 11% by weight. The aqueous phthalocyanine solution is stirred for 1 hour in order that the dispersing agent is completely dissolved.

In a glass beaker, 177 g of a water-soluble polyacrylamide (MW=200 000) are dissolved in 700 g of deionised water by heating the solution to a maximum of 50° C. Once the polymer has dissolved completely, the phthalocyanine solution is added with stirring. The preparation is stirred for one hour and then filtered through a filter having a pore size of 0.5 μm.

The filtrate is granulated in a spray dryer in which the fines produced during the process are continuously separated from the exhaust gas flow and conveyed directly by a gas flow into the spray cone of the nozzle. The granules are free-flowing and have an average particle size of 105 μm. The fines (particle size <20 μm) content is 6.2%. The fraction <50 μm is removed by an air-jet sieve from the particles of the desired size.

The granules are completely soluble in water within a period of less than 2 minutes. When stored in a non-ionic surfactant, no dissolving out of the phthalocyanine compound is detected even after several days.

EXAMPLES 24 TO 34

The formulations listed in the following Table are produced analogously to Example 23 and, after spray-drying, result in granules having the same properties in terms of particle size, solubility in water and non-ionic surfactants as the granules according to Example 23.

| Ex. No. | Dye | % by weight | Anionic dispersing agent | % by weight | Water-soluble polymer | % by weight | Residual moisture in the granules |
|---|---|---|---|---|---|---|---|
| 24 | aluminium phthalocyanine | 7 | oxylignosulfonate sodium salt | 73 | low-viscosity sodium carboxy-methylcellulose | 12 | 8% by weight |
| 25 | zinc phthalo-cyanine | 10 | condensation product of formaldehyde with naph-thalenesulfonic acid | 70 | water-soluble polyacrylamide, MW = 200 000 | 15 | 5% by weight |
| 26 | aluminium phthalocyanine | 12 | alkyl polyglycol ether sulfate sodium salt | 71 | polyvinyl alcohol | 13 | 4% by weight |
| 27 | aluminium phthalocyanine | 15 | sodium ligno-sulfonate | 58 | polyvinyl-pyrrolidone | 18 | 9% by weight |
| 28 | zinc phthalo-cyanine | 12 | condensation product of sulfonated naphthalene with a polychloromethyl-diphenyl mixture | 72 | hydrolysed polyvinyl acetate | 10 | 6% by weight |
| 29 | aluminium phthalocyanine | 10 | sodium ligno-sulfonate | 78 | copolymer of vinyl-pyrrolidone with vinyl acetate | 7 | 5% by weight |
| 30 | zinc phthalo-cyanine | 5 | condensation product of sulfonated naphthalene with a polychloromethyl-diphenyl mixture | 78 | gelatin | 10 | 7% by weight |
| 31 | zinc phthalo-cyanine | 15 | sodium ligno-sulfonate | 65 | polyvinyl alcohol 15 000 | 14 | 6% by weight |
| 32 | zinc phthalo-cyanine | 10 | condensation product of formaldehyde with naph-thalenesulfonic acid | 70 | ammonium salt of a copolymer of ethyl acrylate, methyl meth-acrylate and meth-acrylic acid | 14 | 6% by weight |
| 33 | aluminium phthalocyanine | 11 | alkyl polyglycol ether sulfate sodium salt | 75 | | | 5% by weight |
| 34 | zinc phthalo-cyanine | 5 | condensation product of sulfonated naphthalene with a polychloromethyl-diphenyl mixture | 78 | ammonium salt of a copolymer of ethyl acrylate, methyl methacryl-ate and methacrylic acid | 10 | 7% by weight |

EXAMPLE 35 TO 53

The formulations listed in the following Table are obtained by first of all preparing aqueous solutions of the components and then granulating those solutions in a fluidized spray dryer.

As already described in Example 8, in the first phase of the granulation procedure the equipment is operated as a spray dryer in order to produce in the fluidized bed the nuclei necessary for the granulation ($T_{feed\ air}$=210° C., $T_{bed}$=115° C). Once enough nuclei are present in the fluidized bed for the granulation, the bed temperature is reduced to approximately 65° C. in order to initiate the granulation process. The granulation of the phthalocyanine solution is carried out at a fluidized bed temperature of from 60 to 68° C. The granules discharged from the granulator have a residual moisture content of approximately 12% by weight and are then dried to the formulation-specific desired value (see following Table) in a continuously operating fluidized bed into which air at a temperature of 85° C. is fed. Irrespective of the formulation in question, the granules are free-flowing, are rapidly dissolved in water and are not visibly soluble in non-ionic surfactants for a period of days.

| Ex. No. | Dye | % by weight | Anionic dispersing agent | % by weight | Water-soluble polymer | % by weight | Residual moisture in the granules |
|---|---|---|---|---|---|---|---|
| 35 | zino phthalo-cyanine | 10 | oxylignosulfonate sodium salt | 75 | low-viscosity carb-oxymethylcellulose | 10 | 5% by weight |
| 36 | aluminium phthalo-cyanine | 7 | condensation product of formaldehyde with naphthalenesulfonic acid | 71 | water-soluble polyacrylamide, MW = 200 000 | 15 | 7% by weight |
| 37 | zinc phthalo-cyanine | 8 | dinaphthylmethane-sulfonic acid sodium salt | 74 | sodium polyacrylate | 13 | 5% by weight |
| 38 | zinc phthalo-cyanine | 11 | dinaphthylmethane-sulfonic acid sodium salt | 73 | sodium polymeth-acrylate | 10 | 6% by weight |

-continued

| Ex. No. | Dye | % by weight | Anionic dispersing agent | % by weight | Water-soluble polymer | % by weight | Residual moisture in the granules |
|---|---|---|---|---|---|---|---|
| 39 | zinc phthalo-cyanine | 10 | condensation product of formaldehyde with naphthalene-sulfonic acid | 69 | polyvinyl alcohol 15 000 | 12 | 9% by weight |
| 40 | aluminium phthalo-cyanine | 12 | dialkylsulfosuccinic acid sodium salt | 75 | polyvinyl alcohol | 9 | 4% by weight |
| 41 | aluminium phthalo-cyanine | 15 | heterocyclic poly-sulfonic acid | 62 | polyvinyl-pyrrolidone | 14 | 9% by weight |
| 42 | zinc phthalo-cyanine | 9 | condensation product of formaldehyde with naphthalene-sulfonic acid | 53 | hydrolysed polyvinyl acetate | 12 | 6% by weight |
| | | | condensation product of sulfonated naphthalene with a polychloromethyl-diphenyl mixture | 20 | | | |
| 43 | aluminium phthalocyanine | 8 | sodium ligno-sulfonate | 39 | copolymer of vinylpyrrolidone with vinyl acetate | 9 | 4% by weight |
| | | | dinaphthylmeth-anesulfonic acid sodium salt | 40 | | | |
| 44 | zinc phthalo-cyanine | 10 | condensation product of sulfonated naphthalene with a polychloromethyl-diphenyl mixture | 76 | gelatin | 8 | 6% by weight |
| 45 | aluminium phthalo-cyanine | 15 | dinaphthylmethane-sulfonic acid | 61 | sodium polyacrylate | 15 | 9% by weight |
| 46 | aluminium phthalo-cyanine | 6 | dinaphthylmethane-sulfonic acid, sodium salt | 79 | sodium poly-methacrylate | 10 | 5% by weight |
| 47 | zinc phthalocyanine | 15 | condensation product of formaldehyde with naphthalenesulfonic acid | 43 | polyvinyl alcohol 15 000 | 10 | 7% by weight |
| | | | sodium ligno-sulfonate | 25 | | | |
| 48 | zinc phthalo-cyanine | 11 | alkylnaphthalene-sulfonic acid sodium salt | 66 | sodium salt of a copoly-mer of maleic acid and an unsaturated hydrocarbon | 15 | 8% by weight |
| 49 | aluminium phthalo-cyanine | 10 | dinaphthylmethane-sulfonic acid, sodium salt | 75 | copolymer of polyvinyl alcohol and polyvinyl acetate | 10 | 5% by weight |
| 50 | zinc phthalo-cyanine | 10 | dinaphthylmethane-sulfonic acid, sodium salt | 48 | polycaprolactone | 10 | 8% by weight |
| | | | condensation product of sulfonated naphthalene with a polychloromethyl-diphenyl mixture | 24 | | | |
| 51 | zinc phthalo-cyanine | 10 | condensation product of formaldehyde with naphthalenesulfonic acid | 70 | water-soluble polyacrylamide, MW = 200 000 | 15 | 5% by weight |
| 52 | zinc phthalo-cyanine | 12 | alkylnaphthalene-sulfonic acid sodium salt | 66 | ammonium salt of a copolymer of ethyl acrylate, methyl methacrylate and methacrylic acid | 14 | 8% by weight |
| 53 | zinc phthalo-cyanine | 7 | dinaphthylmethane-sulfonic acid, sodium salt | 77 | ammonium salt of a copolymer of ethyl acrylate, methyl methacrylate and methacrylic acid | 8 | 8% by weight |

EXAMPLE 54

The formulations listed in Examples 45 to 51 are granulated in a fluidized bed granulator (STREA-1, Aeromatic AG) instead of in the fluidized spray dryer. For that purpose, as explained in Example 16 some of the phthalocyanine solution is dried and ground separately and used as nuclei in the granulating procedure.

The granules obtained from the fluidized bed granulation have an average particle size of from 250 to 480 $\mu$m. The average particle size varies within that range according to the composition of the formulation.

What is claimed is:

1. Water-soluble granules of a phthalocyanine compound comprising a) from 2 to 50% by weight of a water-soluble phthalocyanine compound, b) from 40 to 90% by weight of an anionic dispersing agent, c) from 5 to 20% by weight of a water-soluble organic polymer, d) from 0 to 10% by weight of further additives selected from wetting agents, water-insoluble or water-soluble dyes or pigments, dissolution accelerators and optical brighteners and e) from 3 to 15% by weight of water, based on the total weight of the granules.

2. Granules according to claim 1 comprising from 4 to 30% by weight of phthalocyanine compound.

3. Granules according to claim 2 comprising from 5 to 20% by weight of phthalocyanine compound.

4. Granules according to claim 1 comprising from 50 to 90% by weight of anionic dispersing agent.

5. Granules according to claim 1 comprising from 8 to 18% by weight of organic polymer.

6. Granules according to claim 1 comprising as phthalocyanine compound a water-soluble Zn, Fe(II), Ca, Mg, Na, K, Al, Si(IV), P(V), Ti(IV), Ge(IV), Cr(VI), Ga(III), Zr(IV), In(III), Sn(IV) or Hf(VI) phthalocyanine compound.

7. Granules according to claim 6, comprising a phthalocyanine compound of formula $$[Me]_q—[PC]—[Q_1]_r^- A_s^- \quad (1a)$$

or $$[Me]_q—[PC]—[Q_2]_r \quad (1b)$$

wherein

PC is the phthalocyanine ring system;

Me is Zn, Fe(II), Ca, Mg, Na, K, Al—$Z_1$, Si(IV), P(V), Ti(IV), Ge(IV), Cr(VI), Ga(III), Zr(IV), In(III), Sn(IV) or Hf(VI);

$Z_1$ is a halide, sulfate, nitrate, acetate or hydroxy ion;

q is 0, 1 or 2;

r is from 1 to 4;

$Q_1$ is a sulfo or carboxyl group; or a radical of the formula $$—SO_2X_2—R_6—X_3^+;\ —O—R_6—X_3^+;\ \text{or}\ —(CH_2)_t—Y_1^+;$$

wherein $R_6$ is branched or unbranched $C_1$–$C_8$alkylene; or 1,3- or 1,4-phenylene;

$X_2$ is —NH—; or —N—$C_1$–$C_5$alkyl-;

$X_3^+$ is a group of the formula

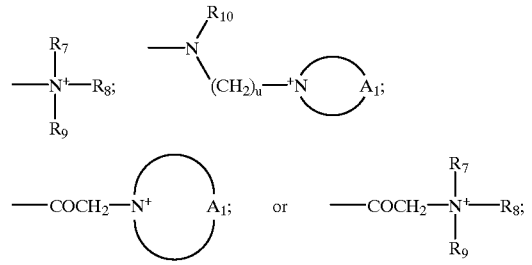

and, in the case where $R_6$=$C_1$–$C_8$alkylene, may also be a group of the formula

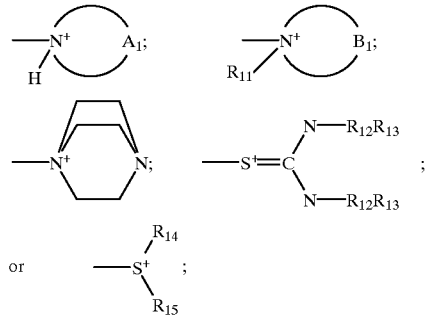

$Y_1^+$ is a group of the formula

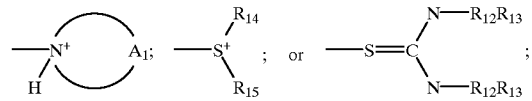

and t is 0 or 1;

and in the above formulae $R_7$ and $R_8$ are each independently of the other $C_1$–$C_6$alkyl;

$R_9$ is $C_1$–$C_6$alkyl; $C_5$–$C_7$cycloalkyl; or $NR_{11}R_{12}$;

$R_{10}$ and $R_{11}$ are each independently of the other $C_1$–$C_5$alkyl;

$R_{12}$ and $R_{13}$ are each independently of the other hydrogen or $C_1$–$C_5$alkyl;

$R_{14}$ and $R_{15}$ are each independently of the other unsubstituted $C_1$–$C_6$alkyl or $C_1$–$C_6$alkyl substituted by hydroxy, cyano, carboxy, $C_1$–$C_6$alkoxycarbonyl, $C_1$–$C_6$alkoxy, phenyl, naphthyl or by pyridyl;

u is from 1 to 6;

$A_1$ is the balance of an aromatic 5- to 7-membered nitrogen heterocycle which may contain one or two further nitrogen atoms as ring members, and $B_1$ is the balance of a saturated 5- to 7-membered nitrogen heterocycle which may contain 1 or 2 further nitrogen, oxygen and/or sulfur atoms as ring members;

$Q_2$ is hydroxy; $C_1$–$C_{22}$alkyl; branched $C_4$–$C_{22}$alkyl; $C_2$–$C_{22}$alkenyl; branched $C_4$–$C_{22}$alkenyl or a mixture thereof; $C_1$–$C_{22}$alkoxy; a sulfo or carboxyl radical; a radical of the formula

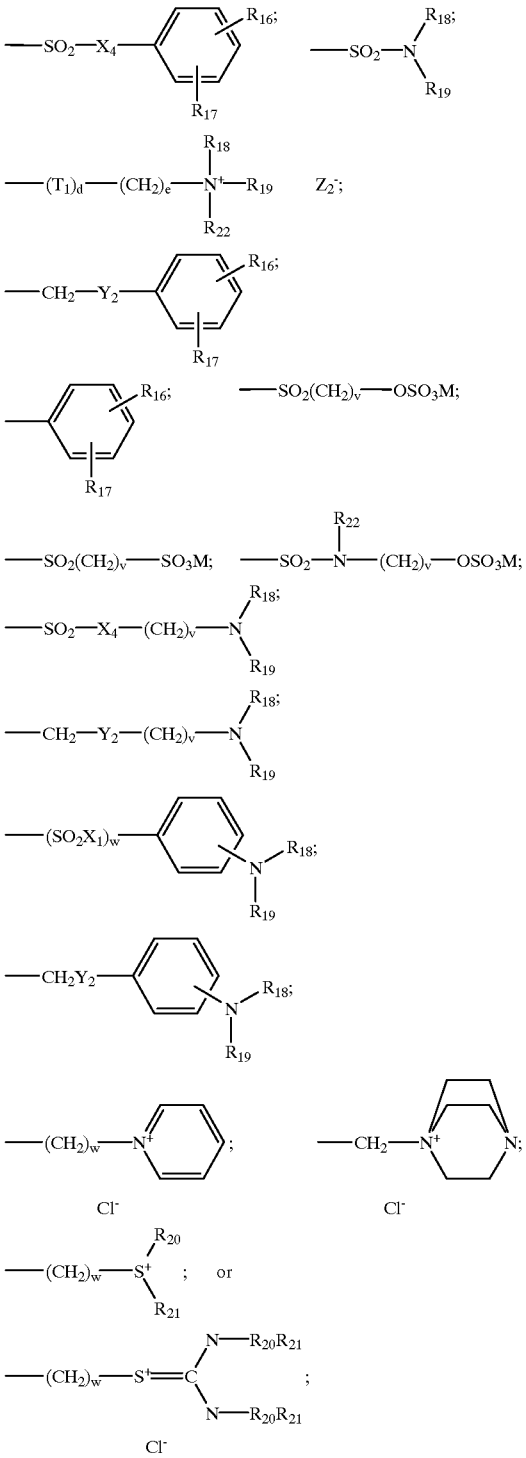

a branched alkoxy radical of the formula

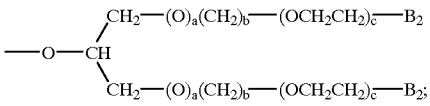

or

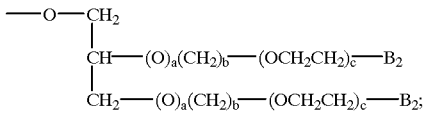

an alkylethyleneoxy unit of the formula $—(T_1)_d—(CH_2)_b(OCH_2CH_2)_a—B_3$ or an ester of the formula $COOR_{23}$, in which formulae $B_2$ is hydrogen; hydroxy; $C_1$–$C_{30}$alkyl; $C_1$–$C_{30}$alkoxy; $—CO_2H$; $—CH_2COOH$; $SO_3^-M_1^+$; $—OSO_3^-M_1^+$; $—PO_3^{2-}$; $M_1$; $—OPO_3^{2-}M_1$; or a mixture thereof;

$B_3$ is hydrogen; hydroxy; —COOH; $—SO_3^-M_1^{30}$ ; $—OSO_3^-M_1^+$; or $C_1$–$C_6$alkoxy;

$M_1$ is a water-soluble cation;

$T_1$ is —O—; or —NH—;

$X_1$ and $X_4$ are each independently of the other —O—; —NH—; or —N—$C_1$–$C_5$alkyl;

$R_{16}$ and $R_{17}$ are each independently of the other hydrogen, a sulfo group or a salt thereof, a carboxyl group or a salt thereof, or a hydroxyl group, at least one of the radicals $R_{16}$ and $R_{17}$ being a sulfo or carboxyl group or a salt thereof, $Y_2$ is —O—, —S—, —NH—or —N—$C_1$–$C_5$alkyl;

$R_{18}$ and $R_{19}$ are each independently of the other hydrogen, $C_1$–$C_6$alkyl, hydroxy-$C_1$–$C_6$alkyl, cyano-$C_1$–$C_6$alkyl, sulfo-$C_1$–$C_6$alkyl, carboxy or halo-$C_1$–$C_6$alkyl; unsubstituted phenyl; or phenyl substituted by halogen, $C_1$–$C_4$alkyl or $C_1$–$C_4$alkoxy, sulfo or by carboxy; or $R_{18}$ and $R_{19}$, together with the nitrogen atom to which they are bonded, form a saturated 5- or 6-membered heterocyclic ring that may in addition contain a further nitrogen atom or an oxygen atom as ring member;

$R_{20}$ and $R_{21}$ are each independently of the other a $C_1$–$C_6$alkyl or aryl-$C_1$–$C_6$alkyl radical;

$R_{22}$ is hydrogen; unsubstituted $C_1$–$C_6$alkyl; or $C_1$–$C_6$alkyl substituted by halogen, hydroxy, cyano, phenyl, carboxy, $C_1$–$C_6$alkoxycarbonyl or by $C_1$–$C_6$alkoxy;

$R_{23}$ is $C_1$–$C_{22}$alkyl, branched $C_4$–$C_{22}$alkyl, $C_1$–$C_{22}$alkenyl or branched $C_4$–$C_{22}$alkenyl; $C_3$–$C_{22}$glycol; $C_1$–$C_{22}$alkoxy; branched $C_4$–$C_{22}$alkoxy; or a mixture thereof;

M is hydrogen; or an alkali metal ion or ammonium ion;

$Z_2$ is a chlorine, bromine, alkyl sulfate or aralkyl sulfate ion;

a is 0 or 1;

b is from 0 to 6;

c is from 0 to 100;

d is 0, or 1;

e is from 0 to 22;

v is an integer from 2 to 12;

w is 0 or 1; and

A is an organic or inorganic anion, and s in the case of monovalent anions $A^-$ is equal to r and in the case of polyvalent anions is $\leqq r$, it being necessary for $A_s^-$ to balance the positive charge; and when $r \neq 1$, the radicals $Q_1$ may be identical or different, and wherein the phthalocyanine ring system may also comprise further solubilising groups.

8. Granules according to claim 7 comprising a phthalocyanine compound of formula

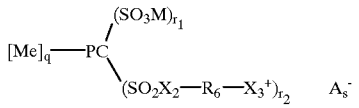

(2a)

wherein

Me, q, PC, $X_2$, $X_3$ and $R_6$ are as defined for formula (1a);

M is hydrogen, or an alkali metal, ammonium or amine salt ion; and the sum of the numbers $r_1$ and $r_2$ is from 1 to 4, and $A_s^-$ exactly balances the positive charge of the remainder of the molecule, or of formula $$[Me]_q—[PC]—[SO_2NHR_6'—X_3'^+A'^-]_r \quad (3)$$

wherein

Me, q and PC are as defined for formula (1a);

$R_6'$ is $C_2$–$C_6$alkylene;

$r_1$ is a number from 1 to 4;

$X_3'$ is a group of the formula

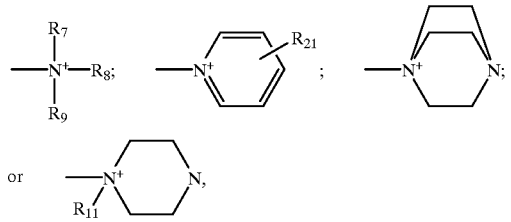

in which formulae $R_7$ and $R_8$ are each independently of the other unsubstituted $C_1$–$C_4$alkyl or $C_1$–$C_4$alkyl substituted by hydroxy, cyano, halogen or by phenyl;

$R_9$ is $R_7$; cyclohexyl or amino;

$R_{11}$ is $C_1$–$C_4$alkyl;

$R_{21}$ is $C_1$–$C_4$alkyl; $C_1$–$C_4$alkoxy; halogen, carboxy, $C_1$–$C_4$alkoxycarbonyl or hydroxy; and A' is a halide, alkyl sulfate or aryl sulfate ion;

wherein the radicals $—SO_2NHR'_6—X_3'^+A^-$ may be identical or different.

9. Granules according to claim 8 comprising a phthalocyanine compound of formula $$[Me]_q—[PC]—[SO_3—Y_3']_r \quad (4)$$

wherein

PC is the phthalocyanine ring system;

Me is Zn, Fe(II), Ca, Mg, Na, K, Al—$Z_1$, Si(IV), P(V), Ti(IV), Ge(IV), Cr(VI), Ga(III), Zr(IV), In(III), Sn(IV) or Hf(VI);

$Z_1$ is a halide, sulfate, nitrate, acetate or hydroxy ion;

q is 1; or 2;

$Y_3'$ is hydrogen, an alkali metal ion or an ammonium ion; and r is any number from 1 to 4.

10. Granules according to claim 9 comprising a phthalocyanine compound of formula (4)

wherein

Me is Zn or Al—$Z_1$; and $Z_1$ is a halide, sulfate, nitrate, acetate or hydroxy ion.

11. Granules according to claim 1 comprising as anionic dispersing agent a condensation product from the following group: condensation products of aromatic sulfonic acids and formaldehyde, condensation products of aromatic sulfonic acids with unsubstituted or chlorinated diphenylene or diphenyl oxides and optionally formaldehyde, (mono-/di-)-alkylnaphthalenesulfonates, sodium salts of polymerised organic sulfonic acids, sodium salts of polymerised alkylnaphthalenesulfonic acids, sodium salts of polymerised alkylbenzenesulfonic acids, alkylarylsulfonates, sodium salts of alkyl polyglycol ether sulfates, polyalkylated polynuclear arylsulfonates, methylene-linked condensation products of arylsulfonic acids and hydroxyarylsulfonic acids, sodium salt of dialkylsulfosuccinic acid, sodium salts of alkyl diglycol ether sulfates, sodium salts of polynaphthalenemethanesulfonates, ligno- or oxylignosulfonates or heterocyclic polysulfonic acids.

12. Granules according to claim 11 comprising as anionic dispersing agent a condensation product from the following group: condensation products of naphthalenesulfonic acids with formaldehyde, sodium salts of polymerised organic sulfonic acids, (mono-/di-)alkylnaphthalenesulfonates, polyalkylated polynuclear arylsulfonates, sodium salts of polymerised alkylbenzenesulfonic acid, lignosulfonates, oxylignosulfonates and condensation products of naphthalenesulfonic acid with a polychloromethyldiphenyl.

13. Granules according to claim 1 comprising as water-soluble polymer a compound from the following group: gelatin, polyacrylates, polymethacrylates, polyvinylpyrrolidones, vinylpyrrolidones, vinyl acetates, copolymers of vinylpyrrolidone with long-chained α-olefins, poly(vinylpyrrolidonedimethylaminoethyl methacrylates), copolymers of vinylpyrrolidone/dimethylaminopropyl methacrylamides, copolymers of vinylpyrrolidone/dimethylaminopropyl acrylamides, quaternised copolymers of vinylpyrrolidones and dimethylaminoethyl methacrylates, terpolymers of vinylcaprolactam/vinylpyrrolidone/dimethylaminoethyl methacrylates, copolymers of vinylpyrrolidone and methacrylamidopropyltrimethylammonium chloride, terpolyrners of caprolactam/vinylpyrrolidone/dimethylaminoethyl methacrylates, copolymers of styrene and acrylic acid, polycarboxylic acids, polyacrylamides, carboxymethylcellulose, hydroxymethylcellulose, polyvinyl alcohols, polyvinyl acetate, hydrolysed polyvinyl acetate, copolymers of maleic acid with unsaturated hydrocarbons, and mixed polymerisation products of the mentioned polymers.

14. Granules according to claim 13 comprising as water-soluble polymer a compound from the following group: carboxymethylcellulose, polyacrylamides, polyvinyl alcohols, polyvinylpyrrolidones, gelatin, hydrolysed polyvinyl acetates, copolymers of vinylpyrrolidone and vinyl acetate, and also polyacrylates and polymethacrylates.

15. A method of producing the granules according to claim 1, wherein first of all an aqueous solution of the phthalocyanine dye is prepared, the anionic dispersing agent and, if desired, further additives are added thereto, the mixture is stirred until a homogeneous solution is obtained, and the aqueous solution is then subjected to a drying step in which all water, with the exception of a residual amount, is removed, solid particles (granules) simultaneously being formed.

16. A method according to claim 15, wherein the removal of water is effected by spray-drying.

17. A method according to claim 16, wherein the removal of water is effected by spray-drying with direct return of the fine particles of solid to the spraying zone.

18. A method according to claim 15, wherein the removal of water is carried out in a fluidized bed dryer.

19. A method according to claim 15, wherein the removal of water is carried out in a fluidized bed granulator.

20. A washing agent formulation comprising

I) from 5 to 70% A) of an anionic surfactant and/or B) of a non-ionic surfactant, II) from 5 to 50% C) of a builder substance, III) from 1 to 12% D) of a peroxide and, where appropriate, a catalyst and IV) from 0.01 to 1% E) of granules according to claim 1, the percentages in each case being percentages by weight, based on the total weight of the washing agent.

21. Granules according to claim 10 comprising a phthalocyanine compound of formula (5)

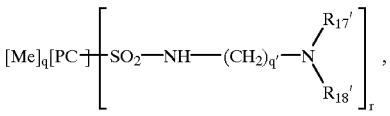

wherein

PC is the phthalocyanine ring system;

Me is Zn, Fe(II), Ca, Mg, Na, K, Al—$Z_1$, Si(IV), P(V), Ti(IV), Ge(IV), Cr(VI), Ga(III), Zr(IV), In(III), Sn(IV) or Hf(VI);

q is 1 or 2;

$R_{17}'$ and $R_{18}'$ are each independently of the other hydrogen, phenyl, sulfophenyl, carboxyphenyl, $C_1$–$C_6$alkyl, hydroxy-$C_1$–$C_6$alkyl, cyano-$C_1$–$C_6$alkyl, sulfo-$C_1$–$C_6$alkyl, carboxy-$C_1$–$C_6$alkyl or halo-$C_1$–$C_6$alkyl or, together with the nitrogen atom, form a morpholine ring;

q' is an integer from 2 to 6; and r is a number from 1 to 4;

wherein, when r>1, the radicals

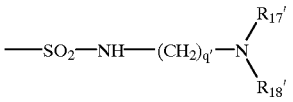

present in the molecule may be identical or different.

22. Granules according to claim 8 comprising a phthalocyanine compound of formula (6)

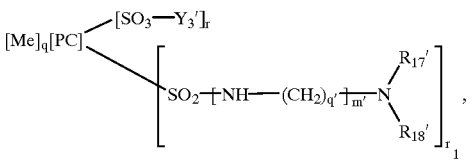

wherein

PC is the phthalocyanine ring system;

Me is Zn, Fe(II), Ca, Mg, Na, K, Al—$Z_1$, Si(IV), P(V), Ti(IV), Ge(IV), Cr(VI), Ga(III), Zr(IV), In(III), Sn(IV) or Hf(VI);

q is 1; or 2;

$Y'_3$ is hydrogen, an alkali metal ion or an ammonium ion;

q' is an integer from 2 to 6;

$R_{17}'$ and $R_{18}'$ are each independently of the other hydrogen, phenyl, sulfophenyl, carboxyphenyl, $C_1$–$C_6$alkyl, hydroxy-$C_1$–$C_6$alkyl, cyano-$C_1$–$C_6$alkyl, sulfo-$C_1$–$C_6$alkyl, carboxy-$C_1$–$C_6$alkyl or halo-$C_1$–$C_6$alkyl or, together with the nitrogen atom, form a morpholine ring, m' is 0 or 1; and r and $r_1$ are each independently of the other any number from 0.5 to 3.5, the sum $r+r_1$ being a minimum of 1 and a maximum of 4.

23. Granules according to claim 8 comprising a phthalocyanine compound of formula (7)

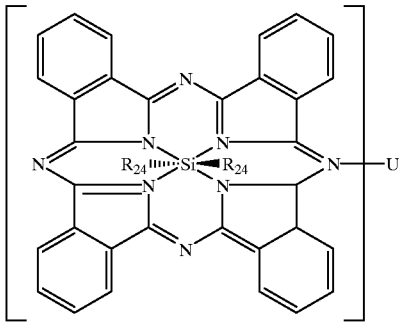

wherein $R_{24}$ is hydroxy; $C_1$–$C_{22}$alkyl; branched $C_4$–$C_{22}$alkyl; $C_1$–$C_{22}$alkenyl; branched $C_4$–$C_{22}$alkenyl or a mixture thereof; $C_1$–$C_{22}$alkoxy; a sulfo or carboxyl radical; a radical of the formula

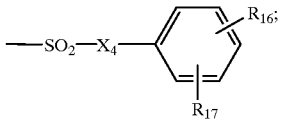

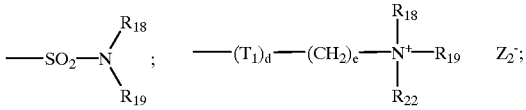

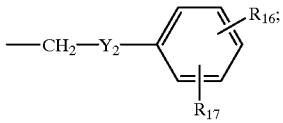

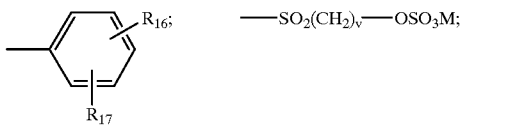

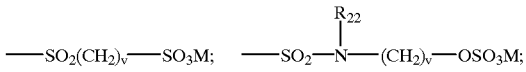

-continued

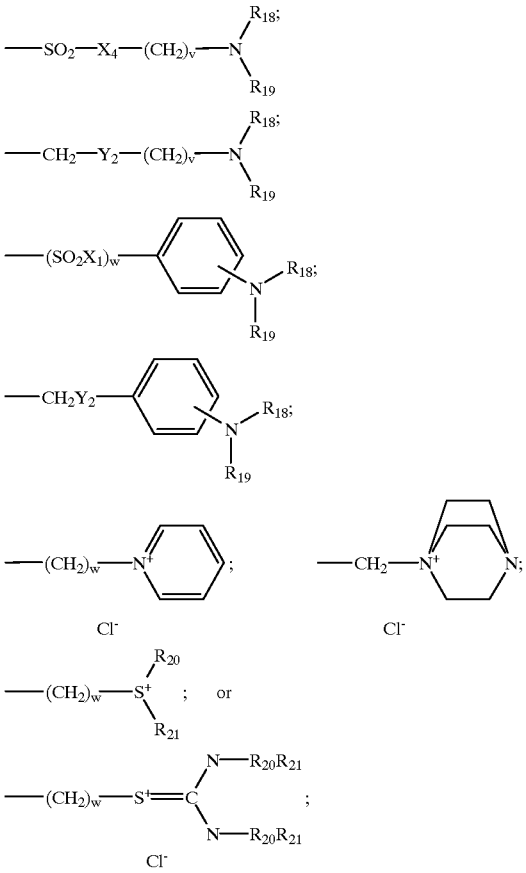

branched alkoxy radical of the formula

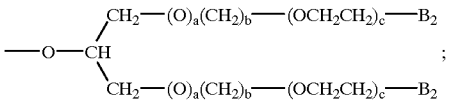

or

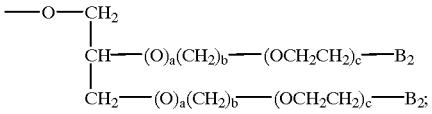

an alkylethyleneoxy unit of the formula $—(T_1)_d—(CH_2)_b(OCH_2CH_2)_a—B_3$ or an ester of the formula $COOR_{23}$; and U is $[Q_1]_r^+A_s^-$; or $Q_2$, $Q_1$ is a sulfo or carboxyl group; or a radical of the formula $—SO_2X_2—R_6—X_3^+$; $—O—R_6—X_3^+$; or $—(CH_2)_t—Y_1^+$;

$Q_2$ is hydroxy; $C_1$–$C_{22}$alkyl; branched $C_4$–$C_{22}$alkyl; $C_2$–$C_{22}$alkenyl; branched $C_4$–$C_{22}$alkenyl or a mixture thereof; $C_1$–$C_{22}$alkoxy; a sulfo or carboxyl radical; a radical of the formula

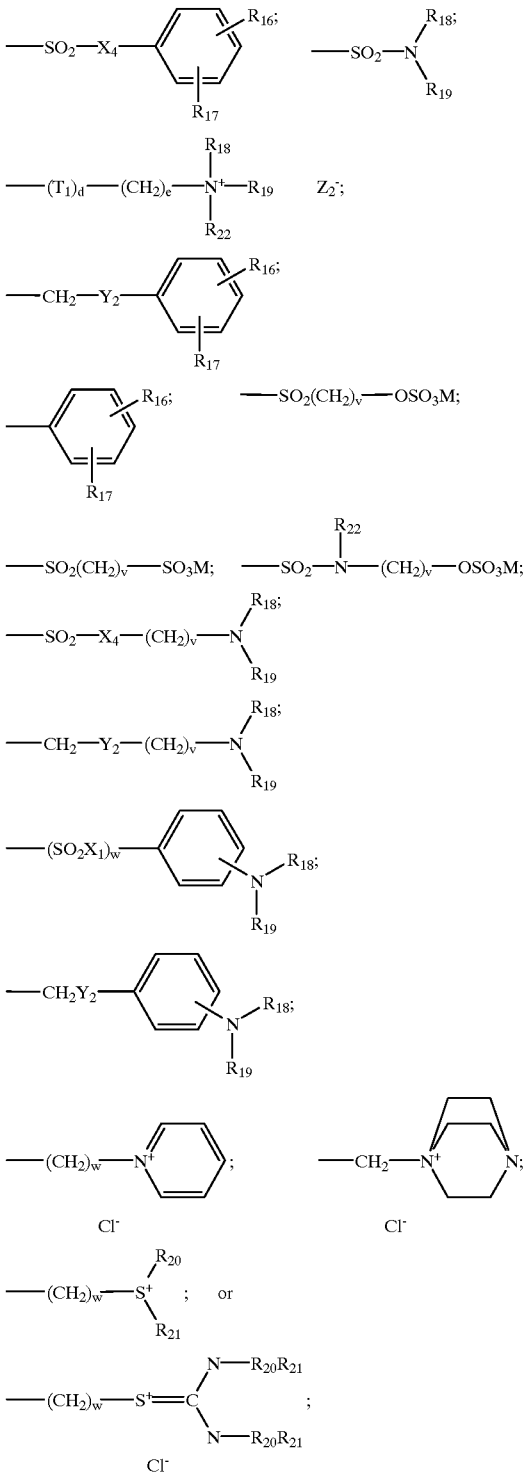

a branched alkoxy radical of the formula

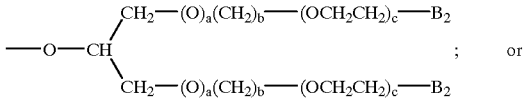

-continued

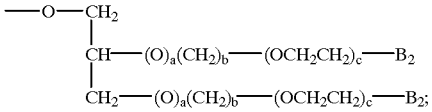

an alkylethyleneoxy unit of the formula $—(T_1)_d—(CH_2)_b(OCH_2CH_2)_a—B_3$ or an ester of the formula $COOR_{23}$, in which formulae $B_2$ is hydrogen; hydroxy; $C_1$–$C_{30}$alkyl; $C_1$–$C_{30}$alkoxy; $—CO_2H$; $—CH_2COOH$; $SO_3^-M_1^+$; $—OSO_3^-M_1^+$; $—PO_3^{2-}$; $M_1$; $—OPO_3^{2-}M_1^+$; or a mixture thereof;

$B_3$ is hydrogen; hydroxy; —COOH; $—SO_3^-M_1^+$; or $C_1$–$C_6$alkoxy; $—OSO_3^-M_1^+$; or $C_1$–$C_6$alkoxy;

$M_1$ is a water-soluble cation;

$T_1$ is —O—; or —NH—;

$X_1$ and $X_4$ are each independently of the other —O—; —NH—; or —N—$C_1$–$C_5$alkyl; $R_{16}$ and $R_{17}$ are each independently of the other hydrogen, a sulfo group or a salt thereof, a carboxyl group or a salt thereof, or a hydroxyl group, at least one of the radicals $R_{16}$ and $R_{17}$ being a sulfo or carboxyl group or a salt thereof, $Y_2$ is —O—, —S—, —NH— or —N—$C_1$–$C_5$alkyl;

$R_{18}$ and $R_{19}$ are each independently of the other hydrogen, $C_1$–$C_6$alkyl, hydroxy-$C_1$–$C_6$alkyl, cyano-$C_1$–$C_6$alkyl, sulfo-$C_1$–$C_6$alkyl, carboxy or halo-$C_1$–$C_6$alkyl; unsubstituted phenyl; or phenly substituted by halogen, $C_1$–$C_4$alkyl or $C_1$–$C_4$alkoxy, sulfo or by carboxy; or $R_{18}$ and $R_{19}$, together with the nitrogen atom to which they are bonded, form a saturated 5- or 6-membered heterocyclic ring that may in addition contain a further nitrogen atom or an oxygen atom as ring member;

$R_{20}$ and $R_{21}$ are each independently of the other a $C_1$–$C_6$alkyl or aryl-$C_1$–$C_6$alkyl radical;

$R_{22}$ is hydrogen; unsubstituted $C_1$–$C_6$alkyl; or $C_1$–$C_6$alkyl substituted by halogen, hydroxy, cyano, phenyl, carboxy, $C_1$–$C_6$alkoxycarbonyl or by $C_1$–$C_6$alkoxy;

$R_{23}$ is $C_1$–$C_{22}$alkyl, branched $C_4$–$C_{22}$alkyl, $C_1$–$C_{22}$alkenyl or branched $C_4$–$C_{22}$alkenyl; $C_3$–$C_{22}$glycol; $C_1$–$C_{22}$alkoxy; branched $C_4$–$C_{22}$alkoxy; or a mixture thereof;

M is hydrogen; or an alkali metal ion or ammonium ion;

$Z_2$ is a chlorine, bromine, alkyl sulfate or aralkyl sulfate ion;

a is 0 or 1;

b is from 0 to 6;

c is from 0 to 100;

d is 0; or 1;

e is from 0 to 22;

r is from 1 to 4;

v is an integer from 2 to 12, and w is 0 or 1; and

A is an organic or inorganic anion, and s in the case of monovalent anions $A^-$ is equal to r and in the case of polyvalent anions is $\leqq r$, it being necessary for $A_s^-$ to balance the positive charge; and when $r \neq 1$, the radicals $Q_1$ may be identical or different.

* * * * *